US007429036B2

(12) United States Patent
McGrane

(10) Patent No.: US 7,429,036 B2
(45) Date of Patent: Sep. 30, 2008

(54) METHOD AND SYSTEM FOR EFFICIENTLY PRINTING AND SORTING MULTIPLE ORDERS OF TRANSACTION CARDS

(75) Inventor: Russell McGrane, Highlands Ranch, CO (US)

(73) Assignee: CPI Card Group, Littleton, CO (US)

( * ) Notice: Subject to any disclaimer, the term of this patent is extended or adjusted under 35 U.S.C. 154(b) by 0 days.

(21) Appl. No.: 10/880,821

(22) Filed: Jun. 29, 2004

(65) Prior Publication Data

US 2006/0087542 A1 Apr. 27, 2006

(51) Int. Cl.
*B41F 13/54* (2006.01)

(52) U.S. Cl. ..... 270/1.01; 355/27; 355/40; 235/488; 235/380

(58) Field of Classification Search ..... 355/27, 355/40; 235/488, 380; 270/1.01
See application file for complete search history.

(56) References Cited

U.S. PATENT DOCUMENTS 7,092,963 B2 * 8/2006 Ryan et al. ..... 707/104.1
2004/0001219 A1 * 1/2004 Wen et al. ..... 358/1.15

* cited by examiner

*Primary Examiner*—Manish S. Shah
*Assistant Examiner*—Laura E Martin
(74) *Attorney, Agent, or Firm*—Marsh Fischmann & Breyfogle LLP

(57) ABSTRACT

A system and method for printing and sorting non-identical transaction cards concurrently includes a printer which is configured to print onto multiple sheets (i) each of a plurality of non-identical transaction cards onto a separate print receiving space on a sheet, and along with each card (ii) a sort indicator which is unique to the print receiving space. After the cards are separated from the sheet they are moved on a conveyor by a series of accumulators seriatim. There is an accumulator corresponding to each print receiving space. Each accumulator collects those cards bearing the sort indicator corresponding to the same space to which the accumulator itself corresponds.

20 Claims, 3 Drawing Sheets

METHOD AND SYSTEM FOR EFFICIENTLY PRINTING AND SORTING MULTIPLE ORDERS OF TRANSACTION CARDS

BACKGROUND OF THE INVENTION

1. Field of the Invention

This invention relates to the field of transaction card manufacture.

2. Prior Art

As used herein (both in connection with the description of the prior art and the description of the invention), the terms "order," "order for cards" and similar terms refer to a request for a number of transaction cards which are identical to each other. Cards are considered identical to each other if they are to be identical up through the end of the printing of the cards. Subsequent processing, such as applying to each card distinguishing indicia, such as user names and account numbers, does not change the nature of such cards being identical to each other for purposes of this disclosure. Cards from different orders are non-identical with respect to each other.

Transaction cards, such as credit cards, identification cards, membership cards and the like, when made pursuant to the prior art are typically made as discussed below.

Each order for cards is printed separately from other orders for cards. A sheet of plastic material is sized to fit a number of cards arranged in rows and columns. For example, a sheet may be sized to hold twenty-eight or fifty-six cards, distributed in seven columns of four rows each for twenty-eight cards or eight rows each for fifty-six cards. Other configurations, such as ninety-six cards distributed in eight columns of twelve rows each, may be used depending upon the size of the printing machines. All cards to be printed on a sheet are identical. Sheets sufficient in number to accommodate the cards for a particular order are fed into a printer (e.g., if there is an order for 20,000 cards and sheets sized for twenty-eight cards are being used, then at least 715 sheets are used). Traditionally, silk-screen printers or offset lithographic printers are used for their high quality output. The cards on each sheet are printed virtually simultaneously (i.e., in a single set of passes for the entire sheet). After all the sheets have been run through the printer (and after other steps familiar in the art), the sheets are moved to a cutter (or puncher) where the cards are punched from the sheet, and then they are either moved to the next station in the card manufacturing process (e.g., for identification number embossing) or, for simpler cards, boxed and shipped to the customer.

This prior art procedure works relatively efficiently when orders in the tens of thousands of cards are being processed. The card printer needs to be set up only once to print many hundreds of sheets.

This procedure does not work efficiently when small orders (e.g., for one hundred cards) for specialty runs or for small institutions are being handled. With only four to twenty sheets being printed per set up, the card printing and cutting machines are frequently shut down as each run is completed and a new printing setup must be put in place. The time lost between printing runs and the labor required for each setup make the processing of small jobs much more costly per card than the processing of large jobs.

Some card manufacturers have tried to solve this problem of inefficiency in printing small orders by resorting to digital printers instead of silk-screen printers or offset lithographic printers. The time required to set up digital printers is much less than that required to set up offset lithographic or silk-screen printers, so the time lost between processing orders is much smaller for digital printers. Even so, the inefficiency is still present, and the quality of the output of digital printers is still generally not as high as the quality of the output of silk-screen printers or offset lithographic printers.

In a prior art method used in connection with silk-screen printers or offset lithographic printers, multiple orders are printed on a each sheet of a run and the cards are sorted by human hands after the cards are punched from the sheets. To increase the speed of the hand sorting, the orders are place on the sheet so as to correspond to the sequence in which the cutter punches the cards from the sheet. In such a procedure the punching step must either be slowed to allow for the hand sorting to keep up. In those cases where the cutter punches out all the cards in a row simultaneously, the orders can be arranged on a row by row basis to speed the hand sorting. However, in such cases, the number of jobs which can be printed on each sheet without making the hand sorting very difficult is limited to the number of rows on each sheet. In any event, the prior art method discussed in this paragraph is still slower and more prone to error than desired.

SUMMARY OF THE INVENTION

Pursuant to the invention described herein, a printer is configured to print onto multiple sheets (i) each of a plurality of non-identical transaction cards onto a separate print receiving space on a sheet, and along with each card (ii) a sort indicator which is unique to the print receiving space. After the cards are separated from the sheet they are moved on a conveyor by a series of accumulators seriatim. There is an accumulator corresponding to each print receiving space. Each accumulator collects those cards bearing the sort indicator corresponding to the same space to which the accumulator itself corresponds.

The method and system of the present invention allows for the printing of multiple orders concurrently, thereby increasing the number of sheets which would be put through a printer in a single run. This increases efficiency substantially over the practice of the prior art. The present invention provides for the sorting of the cards from the printed sheets is a quick and accurate manner.

DETAILED DESCRIPTION OF THE INVENTION

Figure 1:
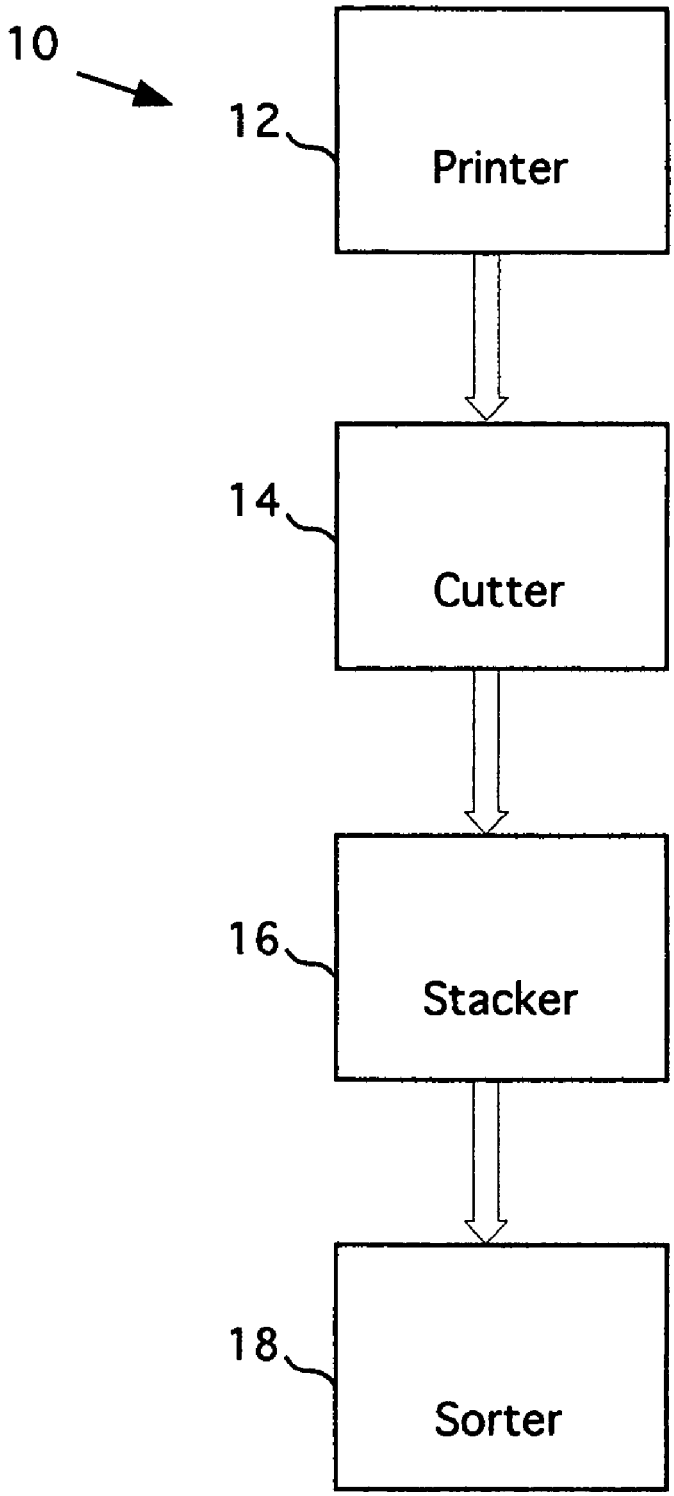
FIG. 1 is a diagrammatic representation of the system of the present invention.

The preferred embodiment of the subject invention is illustrated in the attached drawings which are referred to herein. The same reference numeral will be used to identify identical elements throughout the drawings.

The invention is a method and system for efficiently printing and sorting multiple orders of transaction cards. As discussed above, in the prior art each order for cards would be printed separately from other orders for cards, with a resulting inefficiency as various stages of the card manufacturing process are shut down during the time that a printer is being reconfigured for the next order for cards.

The system of the present invention includes, as shown in FIG. 1, a printer 12 in which the cards are printed onto large sheets, a separator 14 which may be a cutter or punch which cuts or punches the cards from the large sheets and a sorter 18 which sorts the cards into groups corresponding to the original orders which the cards are intended to satisfy. In the preferred embodiment, the system also includes a stacker 16 which stacks the cards after they have been cut from the sheets in preparation for the cards being put into the sorter. The stacker may be a discrete component, or it may be part of the cutter or a part of the sorter.

A discussion regarding the method of the invention will also explain the operation of the system components.

In the method of the present invention, multiple orders are combined together so that the number of sheets for a particular printer run may be increased, thereby reducing the frequency that the printer must be reconfigured. As discussed above, the method is particularly useful in printing small orders for cards because it is with small orders that the greatest inefficiency arises in the prior art.

In practicing the invention, the card manufacturer collects a plurality of small orders for cards. Then the manufacturer allocates spaces on each sheet to be printed such that a large number of sheets would be required to fill the smallest order.

Figure 2:
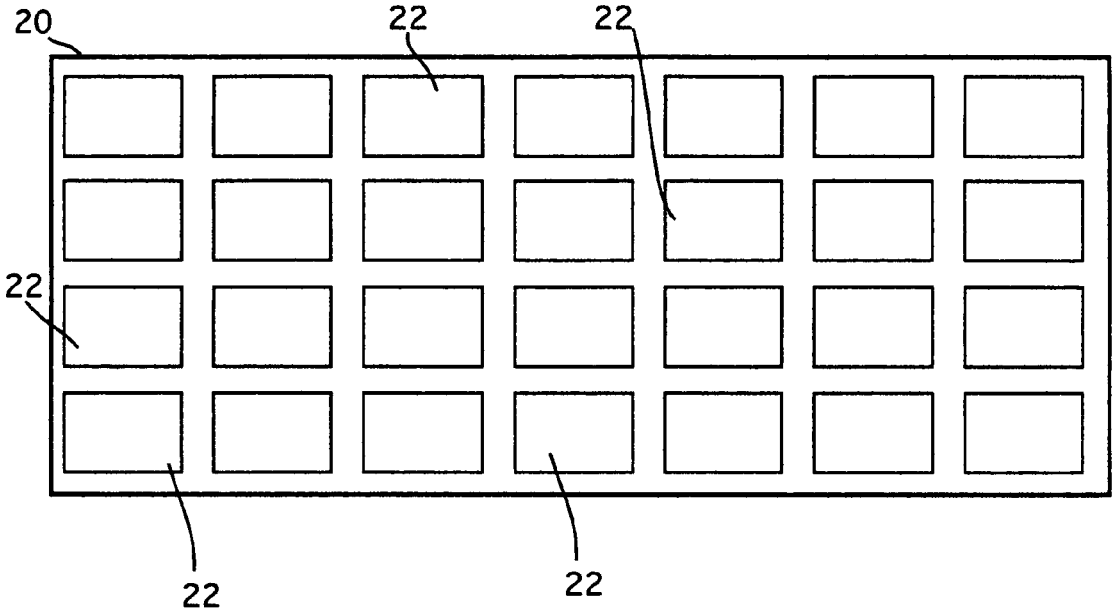
FIG. 2 is a top plan view of a sheet of material from which transaction cards are formed.

By way of example, with reference to FIG. 2, a sheet 20 of card stock (typically plastic for transaction cards) of appropriate size for a particular printer may have twenty-eight print receiving spaces 22, disposed in four rows of seven columns each. If there are eight orders in the group of orders collected by the manufacturer, with the smallest order being for two-hundred cards, then on a sheet having twenty-eight print receiving spaces the smallest order could be allocated one print receiving space on each sheet. The entire batch of eight orders would be allocated cards as follows:

| Order No. | Total Cards In Order | Number of Cards Per Sheet |
|---|---|---|
| Order 1 | 200 | 1 |
| Order 2 | 400 | 2 |
| Order 3 | 600 | 3 |
| Order 4 | 800 | 4 |
| Order 5 | 800 | 4 |
| Order 6 | 800 | 4 |
| Order 7 | 800 | 4 |
| Order 8 | 1200 | 6 |

In this example, a printing run of two-hundred sheets can be made for a single printer setup handling eight orders at once (rather than eight separate printer setups for printing the orders one order at a time). When the numbers do not work out as evenly as they do in this example, a few extra sheets may be run to get the number of cards required for each order without losing the substantial economies which are achieved by avoiding multiple printing runs.)

Each of the print receiving spaces 22 on a sheet is assigned a space location designation. The designation may be a row and column designation (e.g., 2/4 for the space in the second row, fourth column). In the preferred embodiment, each space is assigned a number sequentially, starting with the space in the first row, first column (i.e., the upper left corner of the sheet) and moving from left to right until the end of the row is reached and then continuing in similar fashion row by row until the space in the lower right corner of the sheet. In the example depicted in the drawings, the space location designations are Arabic numbers 1–28.

The card manufacturer then allocates or maps out the spaces on each sheet which will be assigned for each order. Spaces for cards for the same card order do not have to be adjacent to each other. In the example discussed above, the spaces could be allocated as follows:

- the space in the upper left corner of each of the two-hundred sheets (i.e., space assigned space location designation number 1) would be assigned to receive printing for the cards of Order No. 1;
- the spaces in the fourth column of the first and second rows (i.e., spaces assigned numbers 4 and 11) would be assigned to receive printing for the cards of Order No. 2;
- the spaces in the first column of the first, second and third rows (i.e., spaces assigned numbers 8, 15 and 32) would be assigned to receive printing for the cards of Order No. 3;
- the spaces in the second column of all the rows (i.e., spaces assigned numbers 2, 9, 16 and 23) would be assigned to receive printing for the cards of Order No. 4;
- the spaces in the third column of all the rows (i.e., spaces assigned numbers 3, 10, 17 and 24) would be assigned to receive printing for the cards of Order No. 5;
- the spaces in the sixth column of all the rows (i.e., spaces assigned numbers 6, 13, 20 and 27) would be assigned to receive printing for the cards of Order No. 6;
- the spaces in the seventh column of all the rows (i.e., spaces assigned numbers 7, 14, 21 and 28) would be assigned to receive printing for the cards of Order No. 7; and
- the spaces in the fourth column of the third and fourth rows and in the fifth column of all the rows (i.e., spaces assigned numbers 5, 12, 18, 19, 25 and 26) would be assigned to receive printing for the cards of Order No. 8.

The card manufacturer records the print receiving space location designation assignments for the orders. This information will be used later.

The card manufacturer then sets up or configures the printer to print the cards as mapped out (i.e., to print in each print receiving space the card assigned to that space). In addition, the printer is configured to print on each card a sort indicator which corresponds to the space location designation number of the print receiving space in which the card is located.

In summary, the printer is configured to print at least one of each of the non-identical transaction cards onto a separate print receiving space on the sheet, and to print along with each card a sort indicator which is unique to the print receiving space;

The sheets are then inserted into the printer and the cards are printed onto the sheets. In the example discussed above, 200 sheets would be printed, with each printed sheet looking like sheet 20*a* shown in FIG. 3. Each of the sheets is printed so as to be substantially identical to all the other sheets. Minor intended differences may exist; for example sequential sheet control numbers may be printed along an edge of each sheet. As a result of the printing, the print receiving spaces have received printing corresponding to the cards of the orders assigned to them, with the result that each sheet now has cards 24 on it, awaiting to be separated from the sheet. Each card has the appropriate graphics or other printed information 26 pursuant to its order plus a sort indicator 28 printed on it, which sort indicator corresponds to the space location designation number of the space in which the card is located.

The sort indicator may be represented by a symbol or alphanumeric character or a code or by other means. For example, a bar code may be used. In the example discussed here, the sort indicators 28 are Arabic numerals 1–28. In the example, the sort indicator is printed in the upper right hand corner of each card. However, the sort indicator could be printed anywhere on the card. The card manufacturer would usually want to assure that the sort indicator is eventually covered up or is otherwise unnoticeable by the end user of the card.

In the example discussed here, on sheet 20*a* (and all the other sheets printed in the run) the card from Order No. 1 has a circle graphic and the number 1 as its sort indicator, each card from Order No. 2 includes the name "First Bank" and either the number 4 or 11 as its sort indicator, each card from Order No. 3 has a star graphic and has one of the numbers 8, 15 and 22 as its sort indicator, each card from Order No. 4 has a graphic depicting a building and has one of the numbers 2, 9, 16 and 23 as its sort indicator, each card from Order No. 5 has a heptagon graphic and has one of the numbers 3, 10, 17 and 24 as its sort indicator, each card from Order No. 6 has a FIG. -8 racetrack graphic and has one of the numbers 6, 13, 20 and 27 as its sort indicator, each card from Order No. 7 has a clown face graphic and has one of the numbers 7, 14, 21 and 28 as its sort indicator, and each card from Order No. 8 includes the name "Top Bank" and has one of the numbers 5, 12, 18, 19, 25 and 26 as its sort indicator.

The sort indicator may or may not be visible to humans. For example, ink visible only to infrared readers may be used, as discussed further below.

Figure 3:
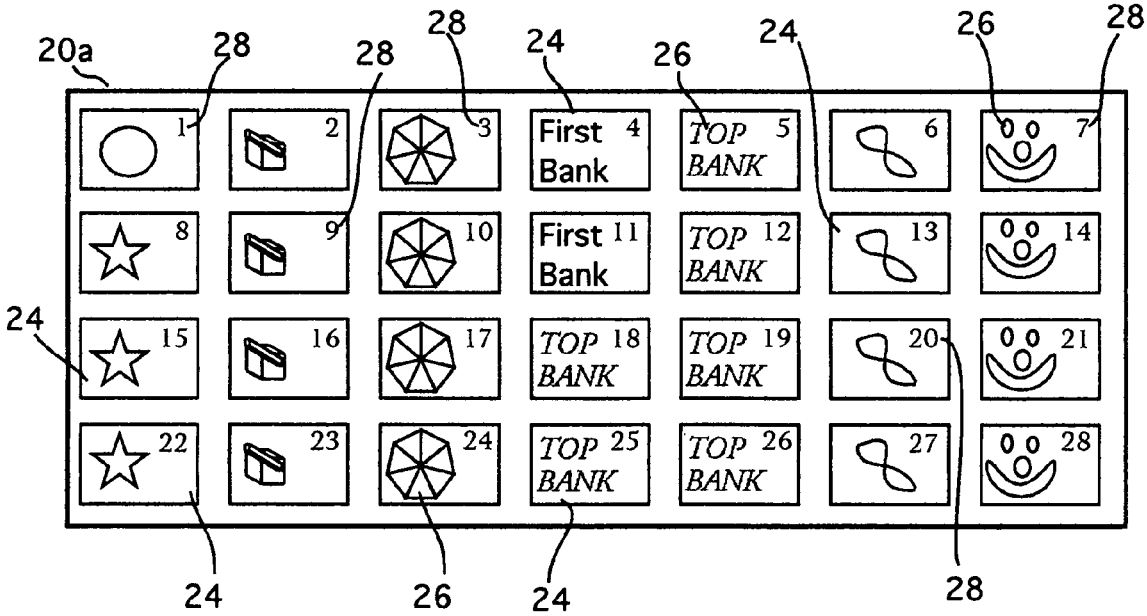
FIG. 3 is a top plan view of the sheet of material shown in FIG. 2 after transaction card graphics and location indicia have been printed on the sheet.

Most transaction cards are printed on both the front surface (as shown in FIG. 3) and on the rear surface of the card. In printing the rear surface, the card manufacturer takes into account that print receiving spaces in each row are reversed (e.g., the second column, which is the second from the left when viewed from the front is the second from the right when viewed from the rear). The sort indicators may also be printed on the rear surface of the cards.

A sort indicator may also be a symbol, graphic element or number a portion of the printing for said card which is to be printed pursuant to the customer's instructions, which symbol, graphic element or number is unique to an order which is part of the printing run (i.e., the sort indicator may be selected from one of the features which would be part of the printing on the card pursuant to the art work submitted to the manufacturer by the customer). By way of example, a telephone number of a bank which would be issuing the transaction cards of a particular order could be used as the sort indicator.

After printing, and other processes known in the art, the printed sheets are taken to a separator 14, which in the preferred embodiment punches the cards 24 from the sheets.

The cards, now separated from the sheets, are, in the preferred embodiment, taken to a stacker which stacks all the cards so that they all have the same orientation (e.g., all with the front surface facing up and the sort indicator in the upper right corner). However, depending on the configuration and sophistication of the sorter, the cards may not need to be oriented the same as each other or even be taken to the stacker at all. In any event, the cards can be mixed in any order.

Figure 4:
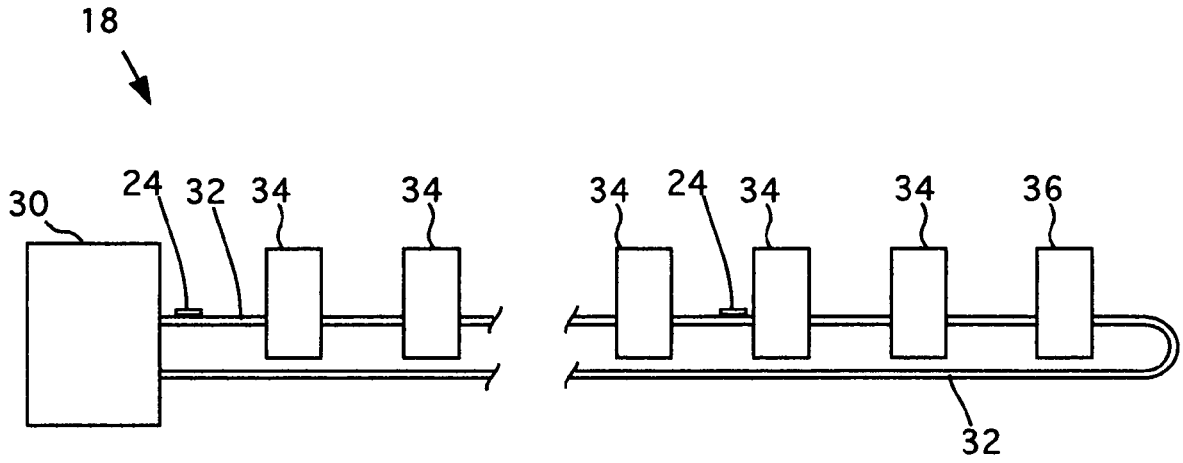
FIG. 4 is a diagrammatic representation of the sorter depicted as part of the system of FIG. 1.
Figure 5:
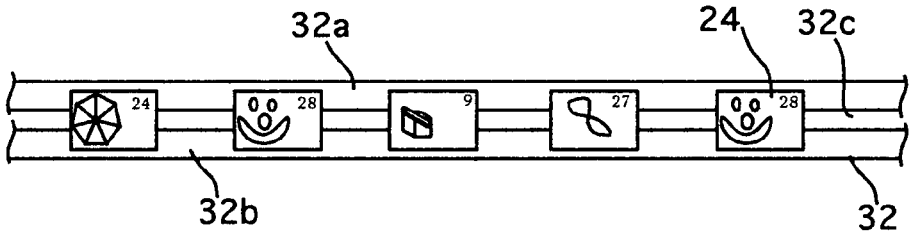
FIG. 5 is a top plan view of a portion of the conveyor belt depicted as part of the sorter of FIG. 4, with transaction cards on the conveyor.

The printed cards are placed in a sorter 18. As shown in FIG. 4, the sorter includes a feeder 30 which is adjacent a card mover 32, which in the preferred embodiment is a conveyor belt. The feeder places the cards in spaced apart relation to each other on the conveyor belt, as shown in FIG. 5 for example. For a reason which will be made clear further below, in the preferred embodiment an opening 32*c* is formed in the conveyor belt so that belt parts 32*a* and 32*b* are separated by that opening. A portion of each card is carried on belt part 32*a* and another portion is carried on belt part 32*b*, with the middle of the card suspended between the two belt parts. The conveyor belt carries the cards one by one by a series of card accumulators 34 disposed one next to another along the path of the conveyor belt. In the preferred embodiment of the invention, there is an accumulator corresponding to each print receiving space 22. So, in the example described herein, there are twenty-eight card accumulators 34. Each card passes by the accumulators seriatim until the card is collected by an accumulator or passes beyond all of them. In this regard, the sorter also includes at least one bypass catcher 36.

Each accumulator 34 includes a sort indicator detector 42, an actuator 44 and a bin 46. In the preferred embodiment, the sort indicator detector and the actuator are electrically connected to each other. Each accumulator is assigned to collect cards originating from a corresponding print receiving space. By way of example, the first accumulator is assigned to collect cards originating from print receiving space number 1, which in the example described herein have had sort indicator 1 printed on them; the second accumulator is assigned to collect cards originating from print receiving space number 2, which in the example described herein have had sort indicator number 2 printed on them; the third accumulator is assigned to collect cards originating from print receiving space number 3, which in the example described herein have had sort indicator number 3 printed on them; and so on through the twenty-eighth card accumulator.

Figure 6:
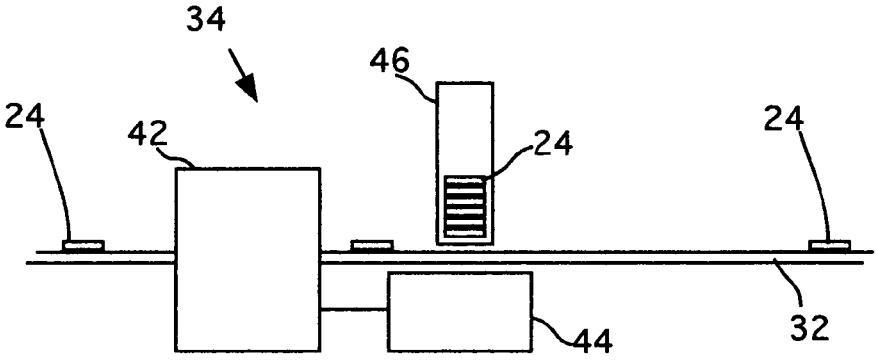
FIG. 6 is a diagrammatic representation of the accumulator depicted as part of the sorter of FIG. 4.

The detector reads the sort indicator on each card moving by it (moving from left to right in FIG. 6) on the conveyor belt. If the detector reads a sort indicator on a card which matches that which is assigned to the accumulator of which the detector is a part, the detector signals the actuator 44 to collect that card. When the card is positioned adjacent the actuator receiving such a signal, the actuator pushes the card into bin 46. In the preferred embodiment the actuator has an air jet which blasts air through the opening 32*c* in the conveyor belt to push the card into bin 46 which is positioned above the belt. Instead of an air jet, the actuator may have a reciprocating mechanical arm which performs the same purpose.

If the detector does not read a matching sort indicator, no signal is sent to the actuator and the card is allowed to pass on to the next accumulator.

The detector may be configured to read the sort indicator wherever it may be placed on the card or to read the sort indicator if it is placed in a particular position, such as the upper right corner of the card in the example discussed herein. The detector may be configured to read whatever type of sort indicator is used (symbol, graphic element or alphanumeric character or code or otherwise). For example, if the sort indicator is a bar code, the detector would be configured with a bar code scanner.

As indicated above, the sort indicator may or may not be visible to humans. For example, the sort indicator may be printed in ink which can only be read with infrared light. In such event, the detector would be configured with infrared lights and infrared sensors.

In theory every card should be collected by an accumulator before it has the chance to be moved on the conveyor belt beyond the last accumulator. However, because of smudging or other printing errors, or because of other unanticipated problems, a card may pass all the detectors without its sort indicator being read as matching any of the accumulators' assigned cards. In such event, the card is collected in the bypass catcher 36. In its simplest form, the bypass catcher can be a box placed at the end of the conveyor belt's forward path so that the card falls off the belt into the box. In the preferred embodiment, the bypass catcher is either (i) the same as an accumulator with its detector set to read any card as a match or (ii) the same as an accumulator, except it has no detector and its actuator is set to push every card passing it into the bypass collector's bin.

In the preferred embodiment, each bin includes an overflow sensor. When the capacity of a bin is exceeded, the sensor sends a signal to the sorter's controller, which causes the feeder and the conveyor belt to stop until that bin is emptied and the sorter is restarted. However, in the preferred embodiment of the invention, a bin exceeding its capacity before completion of sorting of the entire run of cards can easily be made an unlikely event. That is, because there is an accumulator (and bin) for each print receiving space on a sheet, if each bin is made large enough to accommodate cards equal to the number of sheets in the run, card overflow should not be a problem.

After all the cards have been sorted, the card manufacturer empties the bins by order number, with reference to the record made of the print receiving space assignments for the card orders. That is, in the example discussed above, for Order No. 1 the card manufacturer removes the cards from the bin of accumulator 1; for Order No. 2 the card manufacturer removes the cards from the bins of accumulators 4 and 11, for Order No. 3 the card manufacturer removes the cards from the bins of accumulators 8, 15 and 22, for Order No. 4 the card manufacturer removes the cards from the bins of accumulators 2, 9, 16 and 23, for Order No. 5 the card manufacturer removes the cards from the bins of accumulators 3, 10, 17 and 24, for Order No. 6 the card manufacturer removes the cards from the bins of accumulators 6, 13, 20 and 27, for Order No. 7 the card manufacturer removes the cards from the bins of accumulators 7, 14, 21 and 28, and for Order No. 8 the card manufacturer removes the cards from the bins of accumulators 5, 12, 18, 19, 25 and 26.

After the cards for a particular card order are removed from the bins, the cards for that order are either moved to the next station in the card manufacturing process (e.g., identification number embossing) or, for simpler cards, boxed and shipped to the customer just as is done for cards which are printed one order at a time.

As noted above, the sort indicator may be printed on the cards in ink which is not humanly visible or the sort indicator may be a symbol, graphic element or number which is part of the printing pursuant to the art work supplied by the customer. This is desirable because a visible sort indicator added by the card manufacturer may detract from the aesthetics of the card or may cause the end user of the card unwarranted concern. If the sort indicator is humanly visible and is not part of the art work supplied by the customer, it may be desirable to place the sort indicator in an area on the card which would be covered in post-printing manufacturing steps. For example, the sort indicator may be placed in the same area that a hologram label would be applied to the card. In such event, the label would hide the sort indicator.

It is noted that sorting by the overall appearance of the cards in a particular run may work in many cases. However, sometimes non-identical cards look very similar to each other. Sorting by sort indicator provides a much more accurate collection of the cards for each card order.

The invention described herein will function with most, if not all, printers used today for printing large numbers of transaction cards, including offset lithographic, silk screen and digital printers.

In another embodiment of the invention, the number of accumulators need only be at least as great as the number of card orders being processed. In such event, the detectors would be configured to respond positively to any sort indicator associated with the card order. In the example discussed above, if only eight accumulators were used, the first accumulator's detector would respond positively to the sort indicator for the print receiving spaces allocated for Order No. 1, namely sort indicator number 1; the second accumulator's detector would respond positively to sort indicators for the print receiving spaces allocated for Order No. 2, namely sort indicator numbers 4 and 11; and so on.

In still another embodiment, the sort indicators could correspond directly to the card orders. In such event, the printer would be configured so that it would mark all of the cards for Order No. 1 with sort indicator number 1, all the cards for Order No. 2 with sort indicator number 2, and so on. In this embodiment, as in the embodiment described in the paragraph immediately above, the number of accumulators need only be at least as great as the number of card orders being processed, and the detector of each accumulator would be configured to respond positively to the sort indicator for the card order being collected by that accumulator.

The embodiments described in the two paragraphs immediately above are not preferred for at least two reasons. One is that different capacity bins may be required (i.e., the bin for Order No. 1 would have to accommodate only 200 cards while the bin for Order No. 8 would have to accommodate 1200, or six times as much as required of any bin in the example of the preferred embodiment described herein. The other reason is that, with respect to the printer when sort indicators are added in addition to the art work provided by the customer, the set up from one run to next, as far as applying sort indicators, will usually be the same in the preferred embodiment, and therefore more easily accomplished.

If sheets are used which have more print receiving spaces than the number of accumulators available in the sorter, then the sheet should be divided into zones, each zone having a matrix of print receiving spaces corresponding to the number of accumulators. In this regard, if, in connection with the example of the preferred embodiment described herein, a sheet having fifty-six print receiving spaces, arranged in eight rows of seven columns, is used, then the top four rows should be one zone, and treated just like sheet 20 described above, and the bottom four rows should be another zone which is also treated just like sheet 20 described above.

It will be understood that various changes of the details, materials, steps, arrangement of parts and uses which have been herein described and illustrated in order to explain the nature of the invention will occur to and may be made by those skilled in the art, and such changes are intended to be included within the scope of this invention.

I claim the following:

1. A method for printing and sorting a plurality of non-identical transaction cards, said method comprising, (a) configuring a printer to print the plurality of non-identical transaction cards onto print receiving spaces on a sheet such that each print receiving space is set to receive printing for one of said plurality of non-identical transaction cards along with a sort indicator which is unique to said print receiving space;

(b) printing a plurality of sheets pursuant to the configuring of step (a);

(c) separating said cards from said sheets after said plurality of sheets have been printed;

(d) providing a plurality of accumulators such that a separate accumulator corresponds to each respective print receiving space; and (e) moving each card by said accumulators seriatim, with each accumulator detecting the sort indicator on said card passing by it, until one of the following two events occurs: (i) one of said accumulators detects the sort indicator on said card which corresponds to the same print receiving space as does that accumulator, in which event said one of said accumulators collects such card, and (ii) said card passes beyond all of said accumulators without being collected.

2. The method of claim 1 wherein said sort indicator is at least one alphanumeric character.

3. The method of claim 1 wherein said sort indicator is a bar code.

4. The method of claim 1 wherein said sort indicator is printed on said card in a manner such that the sort indicator is not visible to human vision.

5. The method of claim 1 wherein said sort indicator is a portion of the printing for said card on said print receiving space.

6. A method for printing and sorting a plurality of orders for transaction cards, said method comprising, (a) configuring a printer to print at least one card from each order onto a sheet having a plurality of print receiving spaces such that each print receiving space is set to receive printing for one card along with each card a sort indicator which is unique to the order to which said card belongs;

(b) printing a plurality of sheets pursuant to the configuring of step (a);

(c) separating said cards from said sheets after said plurality of sheets have been printed;

(d) providing a plurality of accumulators such that a separate accumulator corresponds to each respective order; and (e) moving each card by said accumulators seriatim, with each accumulator detecting the sort indicator on said card passing by it, until one of the following two events occurs: (i) one of said accumulators detects the sort indicator on said card which corresponds to the same order as does that accumulator, in which event said accumulator collects such card, and (ii) said card passes beyond all of said accumulators without being collected.

7. The method of claim 6 wherein said sort indicator is a portion of the printing for said card.

8. A method for printing and sorting a plurality of orders for transaction cards, said method comprising, (a) configuring a printer to print at least one card from each order onto a sheet having a plurality of print receiving spaces such that each print receiving space is set to receive printing for one card along with each card a sort indicator which is unique to said print receiving space;

(b) correlating said each sort indicator to the order to which the card bearing said sort indicator belongs;

(c) printing a plurality of sheets pursuant to the configuring of step (a);

(d) separating said cards from said sheets after said plurality of sheets have been printed;

(e) providing a plurality of accumulators such that a separate accumulator corresponds to each respective order; and (f) moving each card by said accumulators seriatim, with each accumulator detecting the sort indicator on said card passing by it, until one of the following two events occurs: (i) one of said accumulators detects the sort indicator on said card which corresponds to the same order as does that accumulator, in which event said accumulator collects such card, and (ii) said card passes beyond all of said accumulators without being collected.

9. A method for printing and sorting a plurality of orders for transaction cards, said method comprising, (a) dividing each of a plurality of sheets into a plurality of print receiving spaces;

(b) allocating said print receiving spaces on each sheet for reception of printing such that at least one card from each order of said plurality of orders is assigned to be printed on said sheet;

(c) printing each sheet of said plurality of sheets substantially identically, with each print receiving space of each sheet receiving printing of a card pursuant to the allocating of step (b) along with a sort indicator which is unique to said print receiving space;

(d) separating said cards from said sheets after said plurality of sheets have been printed;

(e) providing a plurality of bins such that a separate bin corresponds to each respective print receiving space;

(f) reading the sort indicator on each card; and (g) correlating the sort indicator read in step (f) with a bin corresponding to the same print receiving space as said sort indicator and putting said card into such bin.

10. A method for printing and sorting a plurality of orders for transaction cards, said method comprising, (a) dividing each of a plurality of sheets into a plurality of print receiving spaces;

(b) allocating said print receiving spaces on each sheet for reception of printing such that at least one card from each order of said plurality of orders is assigned to be printed on said sheet;

(c) printing each sheet of said plurality of sheets substantially identically, with each print receiving space of each sheet receiving printing of a card pursuant to the allocating of step (b), along with a sort indicator which is unique to said print receiving space;

(d) separating said cards from said sheets after said plurality of sheets have been printed;

(e) providing a plurality of accumulators such that a separate accumulator corresponds to each print receiving space; and (f) moving each card by said accumulators seriatim, with each accumulator detecting the sort indicator on said card passing by it, until one of the following two events occurs: (i) one of said accumulators detects the sort indicator on said card which corresponds to the same print receiving space as does that accumulator, in which event said accumulator collects such card, and (ii) said card passes beyond all of said accumulators without being collected.

11. A system for printing a plurality of non-identical transaction cards on a plurality of sheets and sorting said cards after they are separated from said sheets, said system comprising, (a) a printer, said printer being configurable to print the plurality of non-identical transaction cards onto print receiving spaces on a sheet such that each print receiving space is set to receive printing for one of said plurality of non-identical transaction cards along with a sort indicator which is unique to said print receiving space;

(b) a sorter for sorting said cards after they have been separated from said sheets, said sorter including;

(i) a plurality of accumulators such that a separate accumulator corresponds to each print receiving space, each accumulator having a detector for reading the sort indicator on a card moving by it, an actuator responsive to said detector, and a bin for collecting cards, wherein when the detector detects the sort indicator on the card which corresponds to the same print receiving space as does that accumulator, said actuator causes such card to move into said bin, and (ii) a card mover which moves each card by said accumulators seriatim until one of the following two events occurs: (1) one of said accumulators collects such card, and (2) said card passes beyond all of said accumulators without being collected.

12. The system of claim 11, further comprising a card separator which separates said cards from said sheets.

13. The system of claim 11, wherein said sorter further comprises a feeder which positions said cards on said card mover.

14. The system of claim 11, wherein said card mover is a conveyor belt.

15. The system of claim 11 wherein said sort indicator is at least one alphanumeric character.

16. The system of claim 11 wherein said sort indicator is a bar code.

17. The system of claim 11 wherein said sort indicator is not visible to human vision when said card is in completed form.

18. The system of claim 11 wherein said sort indicator is a portion of the printing for said card on said print receiving space.

19. A system for printing and sorting a plurality of orders for transaction cards on a plurality of sheets and sorting said cards after they are separated from said sheets, said system comprising, (a) a printer, said printer being configurable to print at least one card from each order of said plurality of orders onto a separate print receiving space on each of said sheets along with each card a sort indicator which is unique to the order to which said card belongs;

(b) a sorter for sorting said cards after they have been separated from said sheets, said sorter including;

(i) a plurality of accumulators such that a separate accumulator corresponds to each of said orders, each accumulator having a detector for reading the sort indicator on a card passing by it, an actuator responsive to said detector, and a bin for collecting cards, wherein when the detector detects the sort indicator on the card which corresponds to the same order as does that accumulator, said actuator causes such card to move into said bin, and (ii) a card mover which moves each card by said accumulators seriatim until one of the following two events occurs: (1) one of said accumulators collects such card, and (2) said card passes beyond all of said accumulators without being collected.

20. A system for printing and sorting a plurality of orders for transaction cards on a plurality of sheets and sorting said cards after they are separated from said sheets, said system comprising, (a) a printer, said printer being configurable to print at least one card from each order of said plurality of orders onto a separate print receiving space on each of said sheets, and to print along with each card a sort indicator which is unique to said print receiving space;

(b) sorter for sorting said cards after they have been separated from said sheets, said sorter including;

(i) a plurality of accumulators such that a separate accumulator corresponds to each of said orders, each accumulator having a detector for reading the sort indicator on a card moving by it, an actuator responsive to said detector, and a bin for collecting cards, wherein when the detector detects the sort indicator on the card which corresponds to the print receiving space which received printing for the same order as that to which the accumulator corresponds, said actuator causes such card to move into said bin, and (ii) a card mover which moves each card by said accumulators seriatim until one of the following two events occurs: (1) one of said accumulators collects such card, and (2) said card passes beyond all of said accumulators without being collected.

* * * * *